US011314190B2

(12) United States Patent
Tomishima et al.

(10) Patent No.: US 11,314,190 B2
(45) Date of Patent: Apr. 26, 2022

(54) IMAGING SYSTEM

(71) Applicant: Hewlett-Packard Development Company, L.P., Spring, TX (US)

(72) Inventors: Yuichiro Tomishima, Yokohama (JP); Hirokazu Yukawa, Yokohama (JP); Sachiyo Yamada, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/254,441

(22) PCT Filed: Jul. 1, 2019

(86) PCT No.: PCT/US2019/040105
§ 371 (c)(1),
(2) Date: Dec. 21, 2020

(87) PCT Pub. No.: WO2020/027967
PCT Pub. Date: Feb. 6, 2020

(65) Prior Publication Data

US 2021/0223725 A1 Jul. 22, 2021

(30) Foreign Application Priority Data

Jul. 31, 2018 (JP) ..... JP2018-143740

(51) Int. Cl.
*G03G 15/00* (2006.01)
*G03G 15/20* (2006.01)

(52) U.S. Cl.
CPC ..... *G03G 15/6594* (2013.01); *G03G 15/2028* (2013.01); *G03G 15/5029* (2013.01); *G03G 15/6511* (2013.01); *G03G 15/6585* (2013.01)

(58) Field of Classification Search
CPC ..... G03G 15/5029; G03G 15/6558; G03G 15/6588; G03G 15/6591; G03G 15/6594; G03G 15/6511; G03G 2215/00738; G03G 2215/00742; G03G 2215/00751; B41J 11/009
See application file for complete search history.

(56) References Cited

U.S. PATENT DOCUMENTS 5,939,646 A * 8/1999 Fowler ..... G03G 15/5029 73/862.193
6,151,117 A * 11/2000 Tuhro ..... G01D 5/34 250/559.29

(Continued)

FOREIGN PATENT DOCUMENTS

JP 8-122838 A 5/1996
JP 8-268609 A 10/1996

(Continued)

OTHER PUBLICATIONS

Machine Translation of JP 2010-195518. Sep. 9, 2010. (Year: 2010).*

*Primary Examiner* — Carla J Therrien
(74) *Attorney, Agent, or Firm* — Jefferson IP Law, LLP

(57) ABSTRACT

An imaging system includes a roller that conveys a printing medium, a medium sensor that detects a medium property of the printing medium conveyed by the roller, and a controller that adjusts a conveyance speed of the printing medium by the roller based on the medium property detected by the medium sensor.

16 Claims, 10 Drawing Sheets

(56) References Cited

U.S. PATENT DOCUMENTS

| | | | | |
|---|---|---|---|---|
| 6,168,333 | B1 | 1/2001 | Merz et al. | |
| 6,561,643 | B1 | 5/2003 | Walker et al. | |
| 8,235,610 | B2 | 8/2012 | Saito et al. | |
| 2008/0013975 | A1* | 1/2008 | Yasutomi | G03G 15/6573 399/67 |
| 2009/0208236 | A1* | 8/2009 | Katsura | G03G 15/2064 399/68 |
| 2011/0206392 | A1* | 8/2011 | Hiratsuka | G03G 15/161 399/31 |
| 2015/0185186 | A1 | 7/2015 | Han et al. | |
| 2017/0214812 | A1 | 7/2017 | Tomishima | |
| 2018/0072522 | A1* | 3/2018 | Shiokawa | G03G 15/5029 |
| 2018/0148291 | A1* | 5/2018 | Matsumoto | G03G 15/6576 |
| 2018/0246459 | A1* | 8/2018 | Yamamoto | B65H 43/06 |
| 2019/0250548 | A1* | 8/2019 | Tomishima | B41J 11/009 |
| 2019/0302667 | A1* | 10/2019 | Kim | G03G 15/5025 |
| 2020/0026213 | A1* | 1/2020 | Watanabe | G03G 15/0105 |
| 2020/0033782 | A1* | 1/2020 | Sugai | G03G 15/5029 |
| 2020/0300701 | A1* | 9/2020 | Tan | H04N 1/6044 |

FOREIGN PATENT DOCUMENTS

| | | | |
|---|---|---|---|
| JP | 2010-195518 | A | 9/2010 |
| JP | 2010-202380 | A | 9/2010 |

* cited by examiner

*Fig.10*

| THICKNESS | CONVEYANCE SPEED |
|---|---|
| Too Thin | Error |
| Thin | 75% |
| Thick | 50% |
| Heavy | 33% |
| Extra Heavy | 33% |
| Too Heavy | Error |

IMAGING SYSTEM

BACKGROUND

An image forming apparatus includes, for example, a conveying device which conveys a sheet, an image carrier on which an electrostatic latent image is formed, a developing device which develops the electrostatic latent image, a transfer device which secondarily transfers a toner image onto the sheet, a fixing device which fixes the toner image onto the sheet, and a discharge device which discharges the sheet.

BRIEF DESCRIPTION OF DRAWINGS

FIG. 10 is a table illustrating an example control.

DETAILED DESCRIPTION

In the following description, with reference to the drawings, the same reference numbers are assigned to the same components or to similar components having the same function, and overlapping description is omitted.

Figure 1:
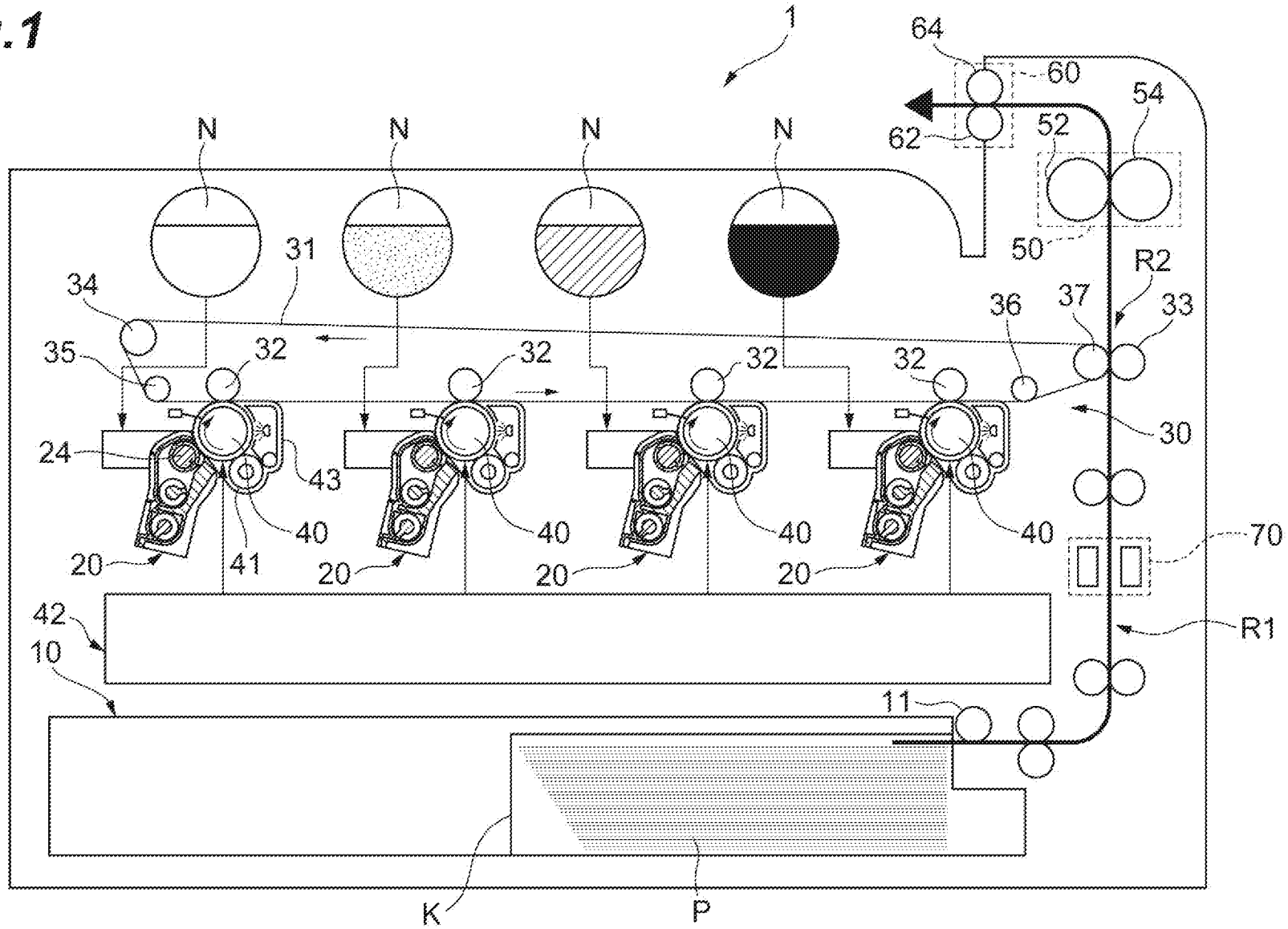
FIG. 1 is a schematic diagram illustrating an example imaging apparatus which can be used to perform various examples disclosed in the present specification.

An example imaging apparatus 1 illustrated in FIG. 1 forms a color image by using magenta, yellow, cyan, and black colors. The imaging apparatus 1 includes, for example, a sheet supply device 10 which supplies a sheet P corresponding to a printing medium, a developing device 20 which develops an electrostatic latent image, and a transfer device 30 which secondarily transfers a toner image onto the sheet P. Additionally, the imaging apparatus 1 may include an image carrier 40 on which an electrostatic latent image is formed, a fixing device 50 which fixes the toner image onto the sheet P, and a discharge device 60 which discharges the sheet P. The imaging apparatus 1 may be a printer, a component of an imaging system, or an imagining system. For example, the imaging apparatus may comprise a developing device used in an imaging system or the like.

The sheet supply device 10 conveys the sheet P as a printing medium having an image formed thereon on the conveying route R1 and supplies the sheet to the transfer nip portion R2. The sheet P is accommodated in a cassette K, for example, in a stacked state and is picked up and conveyed by the first roller 11. The sheet supply device 10 allows the sheet P to reach the transfer nip portion R2 through the conveying route R1 at a timing in which the toner image transferred to the sheet P reaches the transfer nip portion R2.

Four developing devices 20 may be provided for four respective colors. Each developing device 20 includes, for example, a developing agent carrier 24 which carries toner on the image carrier 40. In the developing device 20, a two-component developing agent including toner and carrier may be used as a developing agent. In the developing device 20, the toner and carrier are selectively mixed to have a particular mixing ratio and the toner is uniformly dispersed. Accordingly, the charge amount of the developing agent is selectively adjusted. The developing agent is carried on the developing agent carrier 24. The developing agent carrier 24 rotates so that the developing agent is conveyed to a region facing the image carrier 40. Then, the toner in the developing agent carried on the developing agent carrier 24 moves to the electrostatic latent image formed on the peripheral surface of the image carrier 40 so that the electrostatic latent image is developed.

The transfer device 30 conveys the toner image formed by the developing device 20 to the transfer nip portion R2. The transfer device 30 may include a transfer belt 31 onto which the toner image is primarily transferred from the image carrier 40, suspension rollers 34, 35, 36, and 37 which suspend the transfer belt 31, a primary transfer roller 32 which sandwiches the transfer belt 31 along with the image carrier 40, and a secondary transfer roller 33 which sandwiches the transfer belt 31 with the suspension roller 37.

The transfer belt 31 may be an endless belt which moves in a circulating manner by the suspension rollers 34, 35, 36, and 37. Each of the suspension rollers 34, 35, 36, and 37 is a roller which is rotatable about the axis. The suspension roller 37 may be a drive roller which is rotationally driven about the axis. The suspension rollers 34, 35, and 36 may be driven rollers which are rotated in a following manner in accordance with the rotational driving of the suspension roller 37. The primary transfer roller 32 is provided to press the image carrier 40 from the inner peripheral side of the transfer belt 31. The secondary transfer roller 33 is disposed in parallel to the suspension roller 37 with the transfer belt 31 interposed therebetween and is provided to press the suspension roller 37 from the outer peripheral side of the transfer belt 31. Accordingly, the secondary transfer roller 33 forms the transfer nip portion R2 with respect to the transfer belt 31.

The image carrier 40 is also called an electrostatic latent image carrier, a photosensitive drum, or the like. In some examples, four image carriers 40 are provided, one for each of the respective colors. Each image carrier 40 is provided along the movement direction of the transfer belt 31. For example, the developing device 20, a charging roller 41, an exposure unit 42, and a cleaning device 43 are provided on the periphery of the image carrier 40.

In some examples, the charging roller 41 uniformly charges the surface of the image carrier 40 to a predetermined potential. The charging roller 41 moves to follow the rotation of the image carrier 40. The exposure unit 42 exposes the surface of the image carrier 40 charged by the charging roller 41 in accordance with the image formed on the sheet P. Accordingly, a potential of a portion exposed by the exposure unit 42 in the surface of the image carrier 40 changes so that the electrostatic latent image is formed. For example, four developing devices 20 generate a toner image by developing the electrostatic latent image using toner supplied from a toner tank N provided to face each developing device 20. In some examples, the toner tanks N are respectively charged with magenta, yellow, cyan, and black toners. The cleaning device 43 collects toner remaining on the image carrier 40 after the toner image formed on the image carrier 40 is primarily transferred to the transfer belt 31.

The fixing device 50 allows the sheet P to pass through a fixing nip portion while heating and pressing the sheet so that the toner image secondarily transferred from the transfer belt 31 to the sheet P adheres to the sheet P and the toner image is fixed. The fixing device 50 includes, for example, a heating roller 52 which heats the sheet P and a pressing roller 54 which is rotationally driven while pressing the heating roller 52. The heating roller 52 and the pressing roller 54 may be formed in a cylindrical shape and the heating roller 52 may include a heat source such as a halogen lamp provided therein. A fixing nip portion which is a contact region is provided between the heating roller 52 and the pressing roller 54 and the sheet P passes through the fixing nip portion so that the toner image is melted and fixed to the sheet P.

The discharge device 60 includes, for example, discharge rollers 62 and 64 which discharge the sheet P onto which the toner image is fixed by the fixing device 50 to the outside of the apparatus.

With reference to FIG. 1, an example of a printing process using the imaging apparatus 1 is described. When an image signal of a recording target image is input to the imaging apparatus 1, a control unit of the imaging apparatus 1 rotates the first roller 11 so that the sheet P stacked on the cassette K is picked up and conveyed. Then, the surface of the image carrier 40 is uniformly charged to a predetermined potential by the charging roller 41 (a charging step). Subsequently, an electrostatic latent image is formed by irradiating a laser beam to the surface of the image carrier 40 by the exposure unit 42 based on the received image signal (an exposing step).

In the developing device 20, the electrostatic latent image is developed to form a toner image (a developing step). The toner image which is formed in this way is primarily transferred from the image carrier 40 to the transfer belt 31 in a region in which the image carrier 40 faces the transfer belt 31 (a transferring step). The toner images formed on four image carriers 40 are sequentially laminated on the transfer belt 31 to form one laminated toner image. Then, the laminated toner image is secondarily transferred from the sheet supply device 10 to the sheet P in the transfer nip portion R2 in which the suspension roller 37 faces the secondary transfer roller 33.

The sheet P onto which the laminated toner image is transferred is conveyed to the fixing device 50. Then, the fixing device 50 melts and fixes the laminated toner image to the sheet P by heating and pressing the sheet P between the heating roller 52 and the pressing roller 54 when the sheet P passes through the fixing nip portion (a fixing step). Subsequently, the sheet P is discharged to the outside of the imaging apparatus 1 by the discharge rollers 62 and 64.

Figure 2:
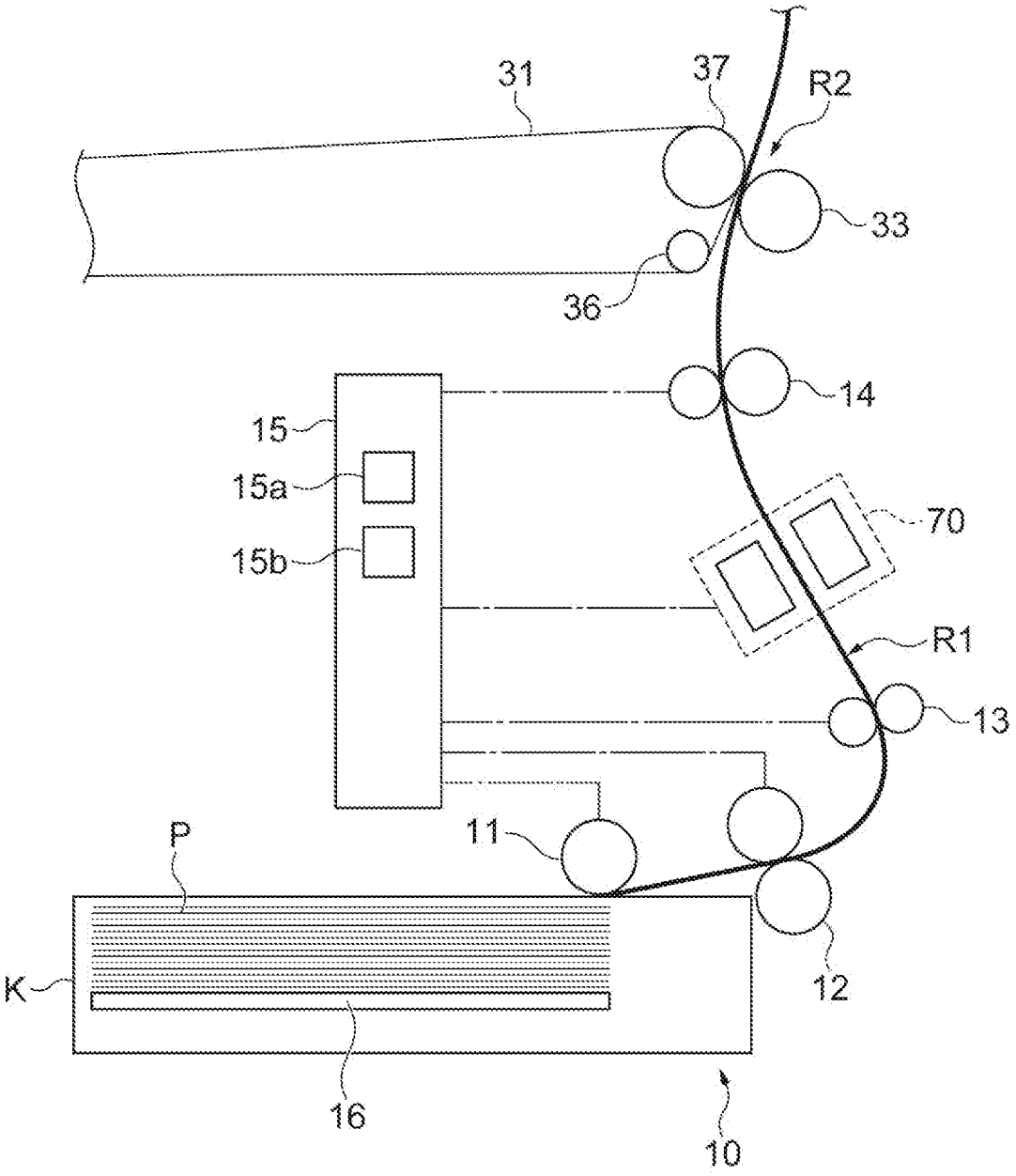
FIG. 2 is a schematic side view illustrating an example sheet supply device.

As illustrated in FIG. 2, the sheet supply device 10 includes the first roller 11, a second roller 12, a third roller 13, and a fourth roller 14 in order from the upstream side in the conveying route R1. The first roller 11 may be a pickup roller and may be formed as a single roller. The first roller 11 conveys the sheet P toward the second roller 12 while rotating with the sheet P interposed between the pressing member 16 and the first roller. The first roller 11 is rotationally driven by, for example, a drive motor. A contact pressure of the first roller 11 with respect to the sheet P, that is, a pressing force between the first roller 11 and the pressing member 16 is variable.

The second roller 12 may be a retard roller for suppressing the sheets P from being conveyed in an overlapping state and may include a pair of rollers. The second roller 12 conveys the sheet P toward the third roller 13 while rotating with the sheet P interposed therebetween. In some examples, one roller constituting the second roller 12 is a drive roller which is rotationally driven by a drive motor and the other roller is a driven roller which is rotated in a following manner in accordance with the rotation of one roller. A contact pressure of the second roller 12 with respect to the sheet P, that is, a pressing force between the pair of rollers constituting the second roller 12 is set to be variable.

The third roller 13 may be a feed roller and may include a pair of rollers. The third roller 13 conveys the sheet P toward the fourth roller 14 while rotating with the sheet P interposed therebetween. In some examples, one roller constituting the third roller 13 is a drive roller which is rotationally driven by a drive motor and the other roller is a driven roller which is rotated in a following manner in accordance with the rotation of one roller. A contact pressure of the third roller 13 with respect to the sheet P, that is, a pressing force between the pair of rollers constituting the third roller 13 is set to be variable.

The fourth roller 14 may be a registration roller which conveys the sheet P to the transfer nip portion R2 while aligning the sheet and may include a pair of rollers. The fourth roller 14 conveys the sheet P toward the transfer nip portion R2 while rotating with the sheet P interposed therebetween. In some examples, one roller constituting the fourth roller 14 is a drive roller which is rotationally driven by a drive motor and the other roller is a driven roller which is rotated in a following manner in accordance with the rotation of one roller.

The sheet supply device 10 further includes a controller 15. The controller 15 is electrically connected to each of components of the sheet supply device 10 and controls the operation of the sheet supply device 10. The controller 15 controls the conveying speed of the sheet P in the sheet supply device 10. In some examples, the controller 15 controls the movement speed of the sheet P conveyed from the cassette K to the fourth roller 14 by the first roller 11, the second roller 12, and/or the third roller 13. The controller 15 may additionally control a contact pressure of the first roller 11, the second roller 12, and/or the third roller 13 with respect to the sheet P.

The controller 15 may be configured as a computer including a processor 15*a* such as a central processing unit (CPU) and a storage unit 15*b* such as a read only memory (ROM) and a random access memory (RAM). The storage unit 15*b* stores a program for controlling the sheet supply device 10. The storage unit 15*b* is, for example, a non-transitory computer readable storage device (storage medium) that stores the program. The controller 15 realizes various kinds of control by reading and executing the program in the processor 15*a*.

As illustrated in FIGS. 1 and 2, the imaging apparatus 1 further includes a medium sensor 70. The medium sensor 70 is disposed on the conveying route R1 and detects the medium property of the sheet P. The medium property detected by the medium sensor 70 may include at least one property of the sheet P, such as the thickness and the glossiness (or other surface property) of the sheet P.

Figure 3:
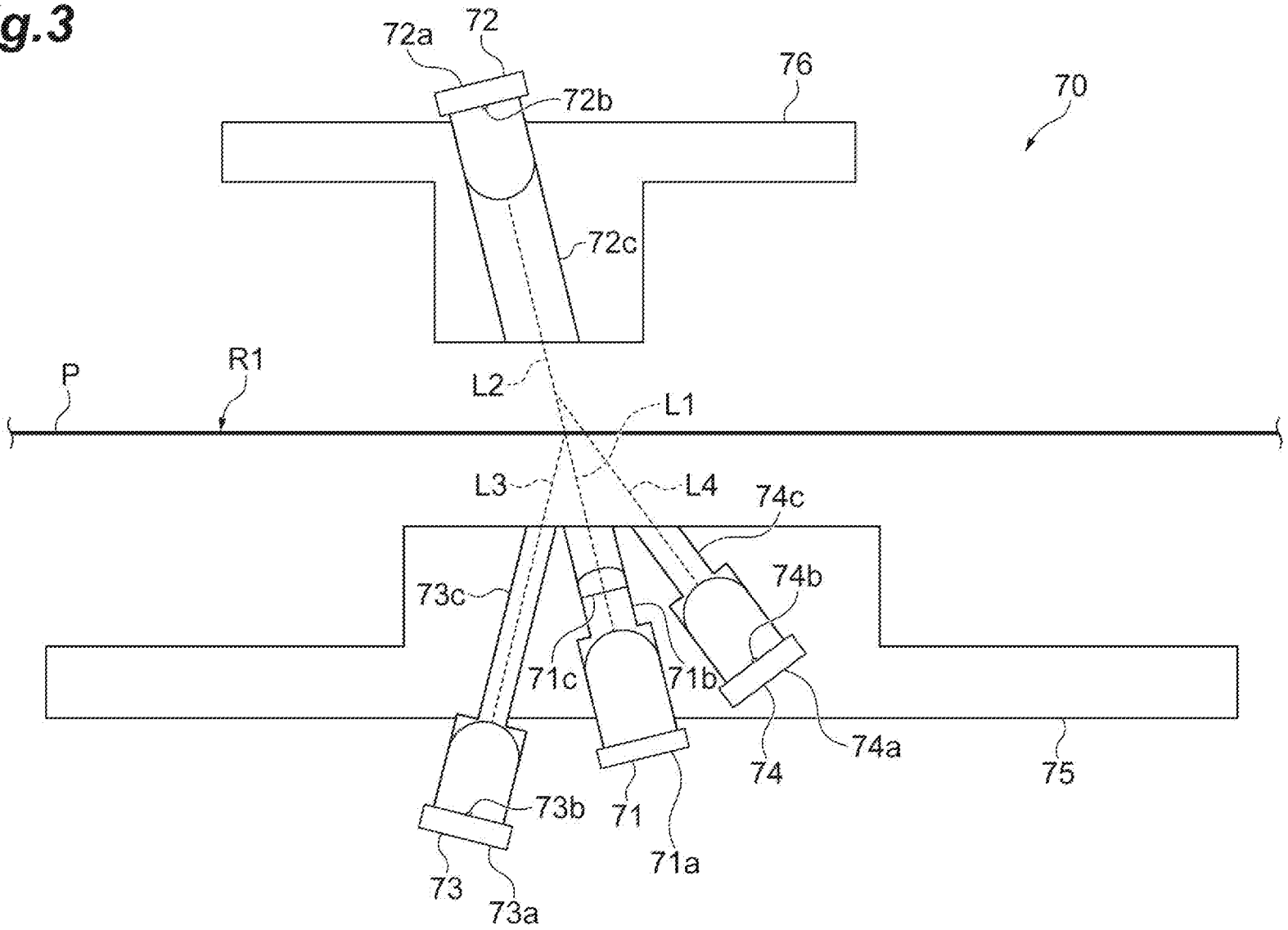
FIG. 3 is a schematic side view illustrating an example medium sensor.

As illustrated in FIG. 3, the medium sensor 70 may include a light emitting portion 71, a first light receiving portion 72, a second light receiving portion 73, a third light receiving portion 74, and support members 75 and 76. The light emitting portion 71, the second light receiving portion 73, and the third light receiving portion 74 are fixed to the support member 75. The first light receiving portion 72 is fixed to the support member 76 and is disposed on the opposite side to the light emitting portion 71, the second light receiving portion 73, and the third light receiving portion 74 in the conveying route R1.

The light emitting portion 71 irradiates light L1 to the sheet P conveyed by the sheet supply device 10. The light emitting portion 71 includes, for example, a light emitting element 71*a*, a lens barrel 71*b*, and a convex lens 71*c*. The lens barrel 71*b* restricts the light emission range of the light output from the light emitting element 71*a*. The convex lens 71*c* is disposed inside the lens barrel 71*b*. Since the convex lens 71*c* is provided, a parallel light component (a component parallel to an optical axis) included in the light L1 increases.

The first light receiving portion 72 detects light (a first part) L2 transmitted through the sheet P. The first light receiving portion 72 may include a light receiving element 72*a* with an optical detector 72*b* and a lens barrel 72*c*. The lens barrel 72*c* restricts an incident range (a viewing range) of light incident on the optical detector 72*b*. The second light receiving portion 73 detects light (a second part) L3 reflected by the sheet P. The second light receiving portion 73 includes, for example, a light receiving element 73*a* with a detector 73*b* and a lens barrel 73*c*. The lens barrel 73*c* restricts an incident range of light incident on the detector 73*b*. The third light receiving portion 74 detects light (a third part) L4 diffused and reflected by the sheet P. The third light receiving portion 74 may include a light receiving element 74*a* with a detector 74*b* and a lens barrel 74*c*. The lens barrel 74*c* restricts an incident range of light incident on the detector 74*b*.

In the medium sensor 70, the thickness of the sheet P can be detected based on the strength of the light L2 detected by the first light receiving portion 72. The glossiness of the sheet P can be detected based on the strength of the light L3 detected by the second light receiving portion 73 and the strength of the light L4 detected by the third light receiving portion 74. The second light receiving portion 73 and the third light receiving portion 74 may not be provided when the thickness of the sheet P is separately or individually detected. Similarly, the first light receiving portion 72 may not be provided when the glossiness of the sheet P is separately or individually detected.

Figure 4:
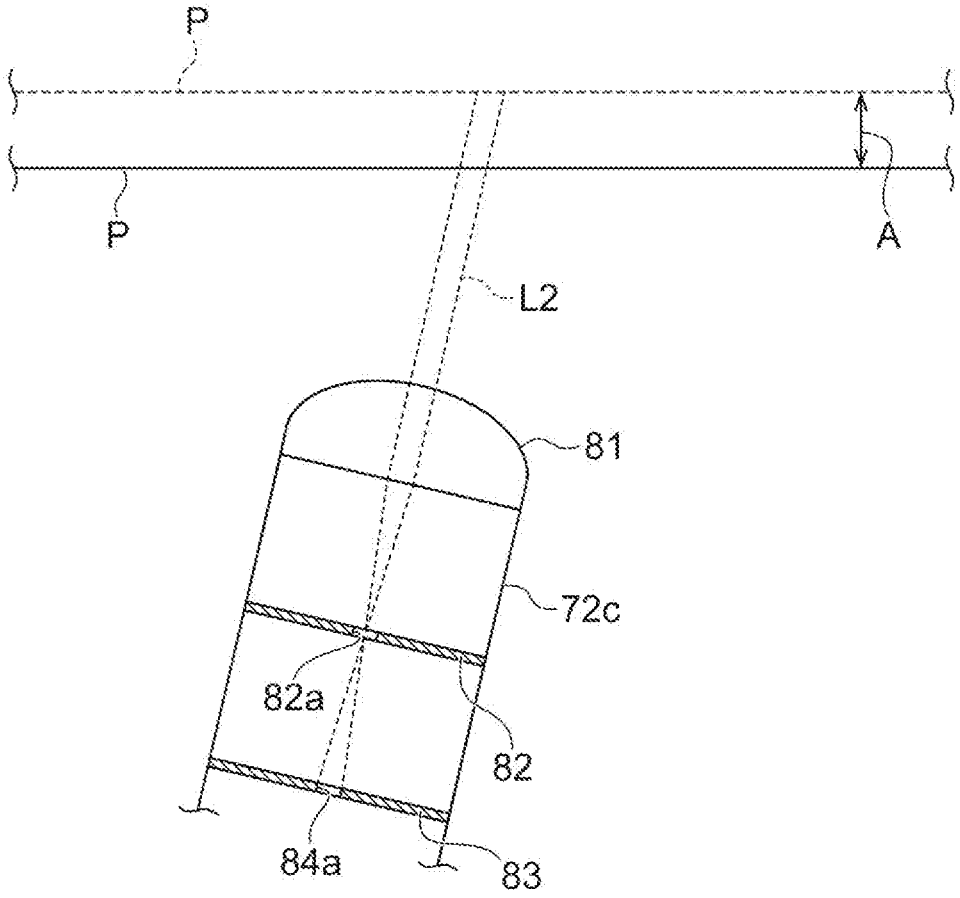
FIG. 4 is a schematic side view illustrating an example light receiving portion.
Figure 5A:
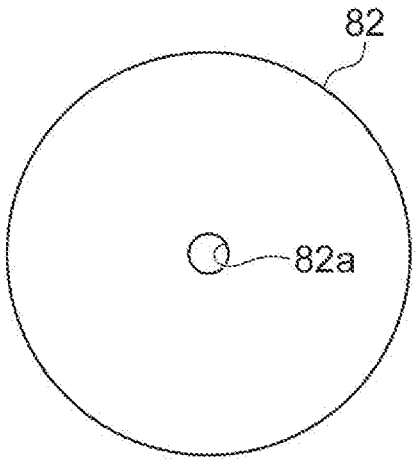
FIGS. 5(*a*) and 5(*b*) are schematic front views illustrating an example diaphragm member and a transparent diffusion member.
Figure 5B:
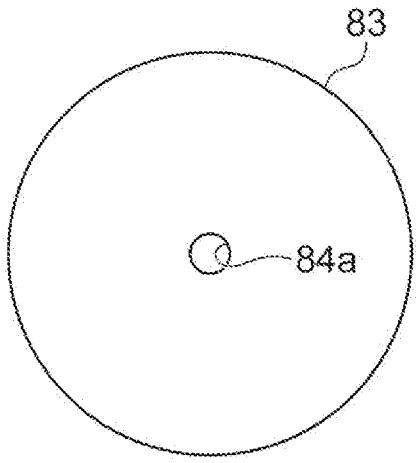

Referring to FIGS. 4, 5(*a*), 5(*b*), and 6, the configurations of the first light receiving portion 72, the second light receiving portion 73, and the third light receiving portion 74 are described. In this example, the first light receiving portion 72, the second light receiving portion 73, and the third light receiving portion 74 have the same structure. Hereinafter, in describing the first light receiving portion 72, a description of the second light receiving portion 73 and a description of the third light receiving portion 74 are omitted.

The first light receiving portion 72 includes a convex lens 81, a diaphragm member 82, and a transparent diffusion member 83. The convex lens 81 is disposed at, for example, a front end of the lens barrel 72*c*. The diaphragm member 82 may be formed in a disc shape. The center of the diaphragm member 82 is provided with a circular opening 82*a*. The diaphragm member 82 is disposed on the side of the light receiving element 72*a* with respect to the convex lens 81 inside the lens barrel 72*c*. In some examples, the diaphragm member 82 is disposed in a direction perpendicular to the optical axis of the light L2. The diaphragm member 82 is disposed so that the opening 82*a* is located at the focal position of the convex lens 81.

The diaphragm member 82 allows the light to pass through the opening 82*a* and interrupts the light in a region other than the opening 82*a*. The convex lens 81 and the diaphragm member 82 constitute a telecentric optical system. The diaphragm member 82 is formed so that a parallel light component (a component parallel to an optical axis) in the light incident on the convex lens 81 passes through the opening 82*a* and a component other than the parallel light component is interrupted by the diaphragm member 82.

The transparent diffusion member 83 has, for example, the same shape as that of the diaphragm member 82 in plan view. The transparent diffusion member 83 includes a light shielding layer 84 and a diffusion layer 85. The light shielding layer 84 is disposed on a surface on the side of the diaphragm member 82 in the diffusion layer 85. The center of the light shielding layer 84 may be provided with a circular opening 84*a*. The opening 84*a* has, for example, the same shape as that of the opening 82*a* of the diaphragm member 82. The transparent diffusion member 83 is disposed between the diaphragm member 82 and the light receiving element 72*a* inside the lens barrel 72*c*. The transparent diffusion member 83 may be disposed perpendicular to the optical axis of the light L2. The light shielding layer 84 allows the light to pass through the opening 84*a* and interrupts the light in a region other than the opening 84*a*. The diffusion layer 85 allows the light passing through the opening 84*a* to be transmitted and diffused.

Figure 6:
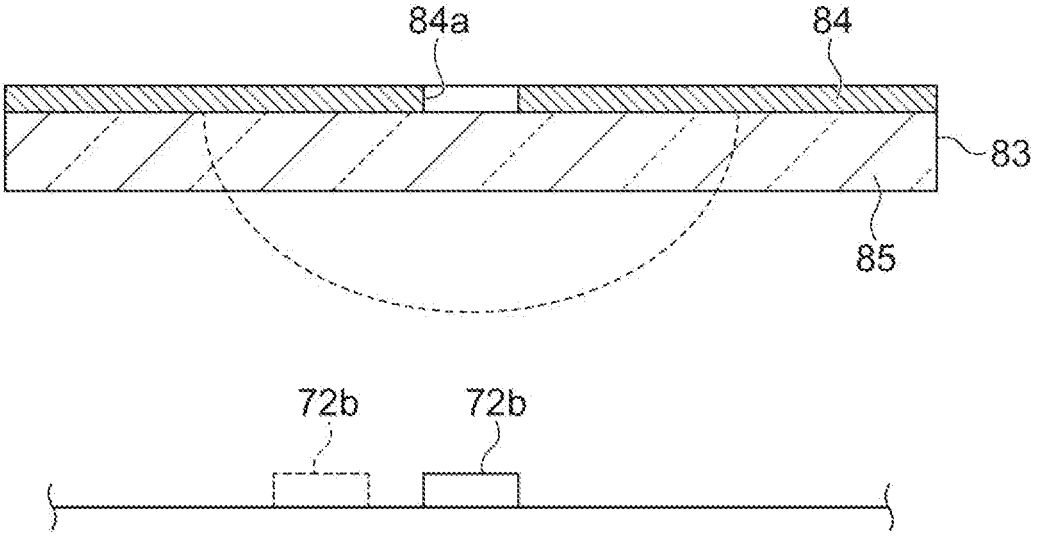
FIG. 6 is a schematic view illustrating an example transparent diffusion member and an optical detector.

FIG. 6 schematically illustrates a state in which light diffused by the transparent diffusion member 83 is detected by the optical detector 72*b*. In FIG. 6, a configuration other than the optical detector 72*b* in the light receiving element 72*a* is omitted. According to the above-described example structure, the light diffused by the transparent diffusion member 83 can be detected by the optical detector 72*b* even when a position of the optical detector 72*b* is offset to a position indicated by a dashed line in FIG. 6 due to a manufacturing error or the like.

Figure 7A:
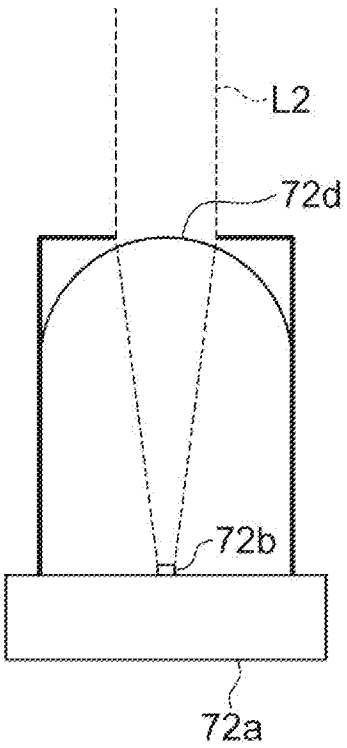
FIGS. 7(*a*), 7(*b*), and 7(*c*) are schematic side views illustrating an example light receiving portion.
Figure 7B:
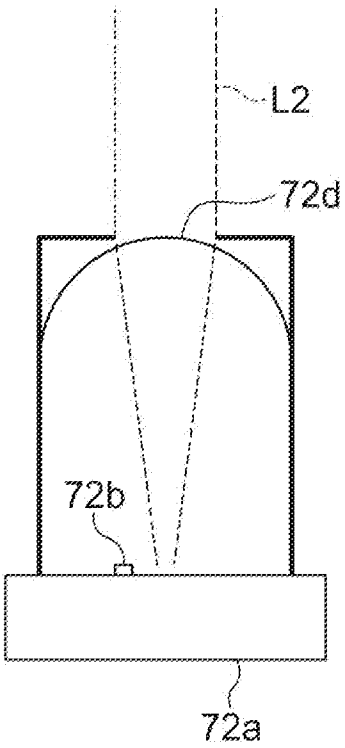
Figure 7C:
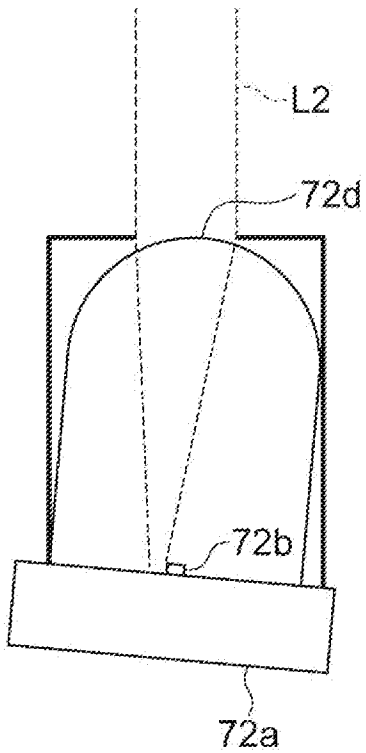

In some examples, the optical detector 72*b* is disposed at a target position illustrated in FIG. 7(*a*). However, in other examples the position of the optical detector 72*b* is offset from the target position as illustrated in FIG. 7(*b*) or the light receiving element 72*a* is inclined from the target position as illustrated in FIG. 7(*c*) so that the position of the optical detector 72*b* is offset from the target position. In some examples, the light diffused by the transparent diffusion member 83 may be detected using the optical detector 72*b* even when the position of the optical detector 72*b* is offset from the target position. Furthermore, the light receiving element 72*a* includes a lens portion 72*d* and the light condensed by the lens portion 72*d* is incident on the optical detector 72*b*.

In some examples, the parallel light component in the light incident on the convex lens 81 passes through the opening 84*a* of the diaphragm member 82 and is detected by the optical detector 72*b*. Accordingly, the light L2 may be detected from the same range (the range of the same size) of the sheet P as illustrated in FIG. 4 even when the conveying position of the sheet P is offset. Additionally, the conveying position of the sheet P may be offset (changed) by 2 mm or so in a direction perpendicular to the plane on which the sheet P is conveyed. In FIG. 4, the offset is indicated by Sign A.

Figure 8:
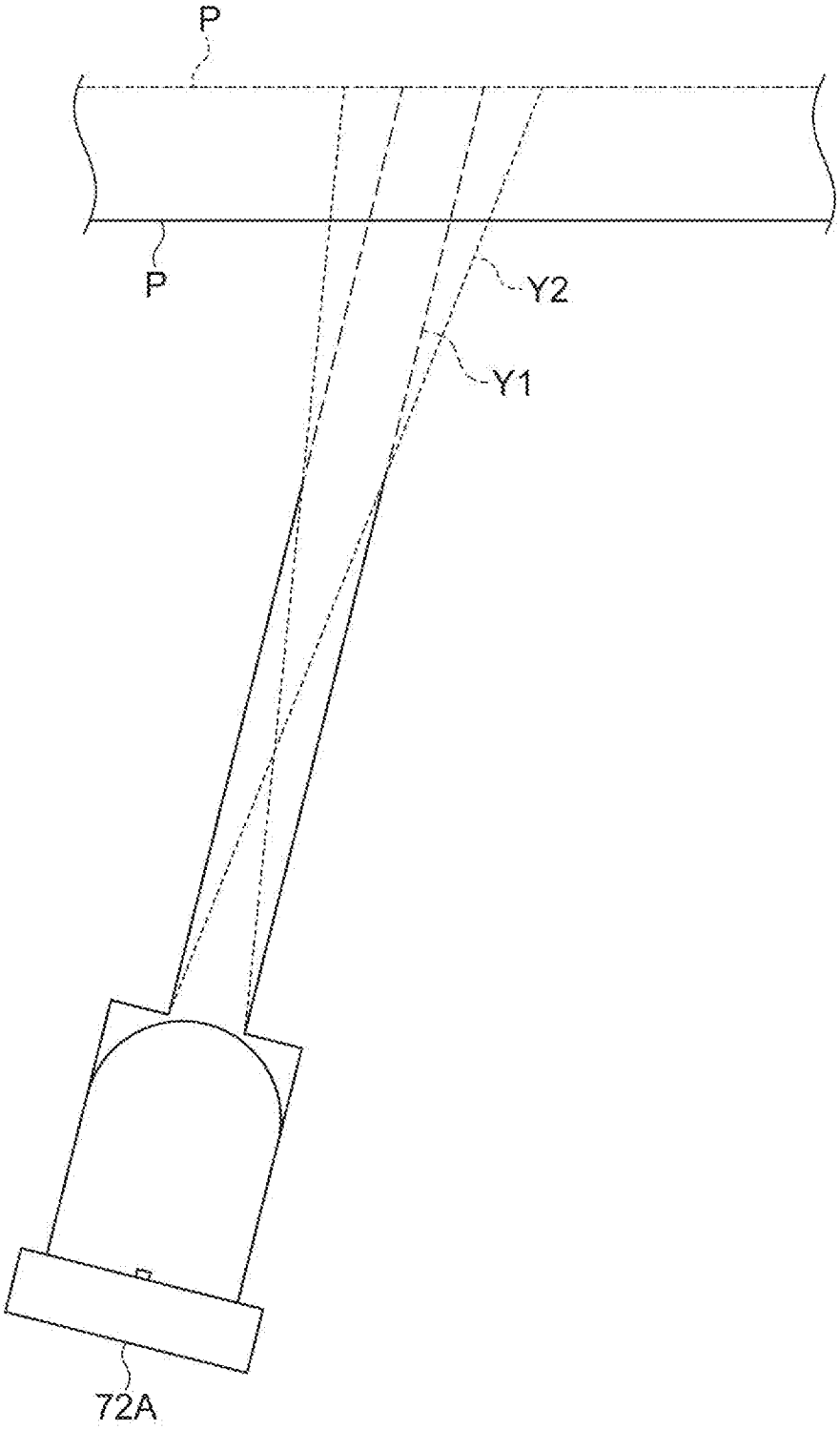
FIG. 8 is a schematic side view illustrating a light receiving portion of an example imaging apparatus.

When the convex lens 81, the diaphragm member 82, and the transparent diffusion member 83 are not provided as in the light receiving portion 72A of the example imaging apparatus illustrated in FIG. 8, both parallel light Y1 and diffused light Y2 may be incident on the light receiving portion 72A. As illustrated in FIG. 8, the range of the diffused light Y2 incident on the light receiving portion 72A changes in accordance with a change in the conveying position of the sheet P. As a result, the detection accuracy of the medium property of the sheet P can be degraded. In contrast, according to the first light receiving portion 72, the parallel light component is detected. Accordingly, the medium property of the sheet P may be accurately detected even when the conveying position of the sheet P changes.

Figure 9:
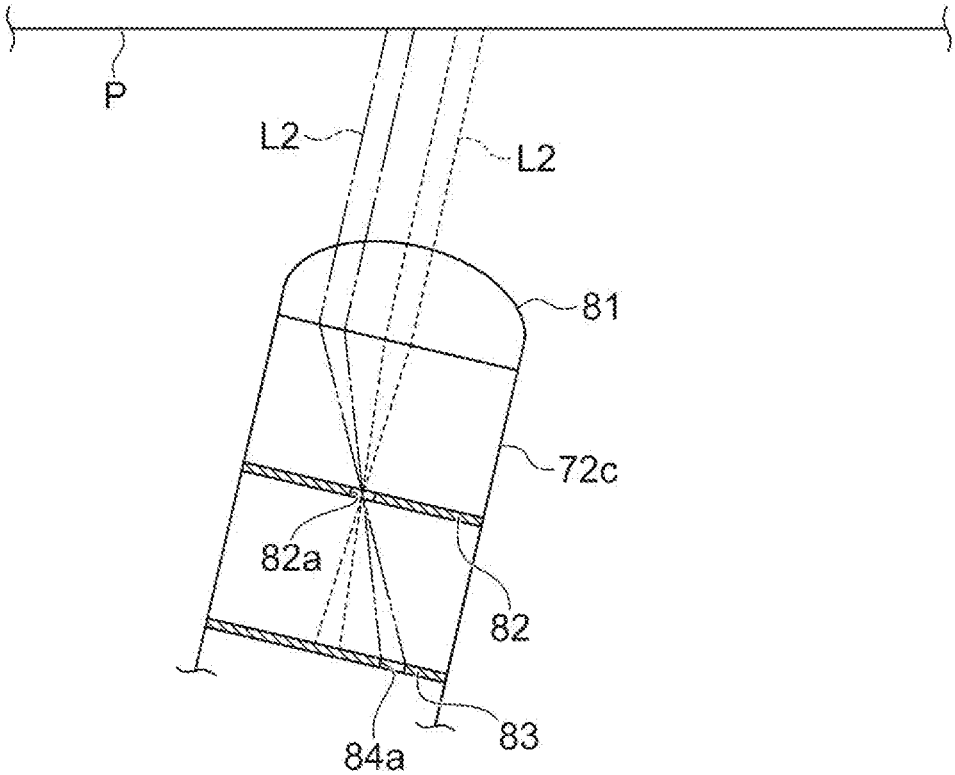
FIG. 9 is a schematic side view illustrating an example light receiving portion.

As illustrated in FIG. 9, a different position of the sheet P may be observed with the same sensitivity by changing the position of the opening 84*a* of the transparent diffusion member 83. For example, the detection range of the sheet P may be regulated by the transparent diffusion member 83. Additionally, the position, the shape, and the area of the opening 84*a* of the transparent diffusion member 83 may be arbitrarily changed in accordance with the observation position or the like of the sheet P.

An example control performed in the imaging apparatus 1 is described with reference to FIG. 10. The control may be performed by the controller 15. The controller 15 adjusts the conveying speed of the sheet P in the sheet supply device 10 based on, for example, the thickness of the sheet P detected by the medium sensor 70. The controller 15 may adjust the conveying speed of the sheet P by changing the rotation speed of each of the first roller 11 and the third roller 13.

The controller 15 sets the conveying speed to 75% when the thickness is in a range corresponding to "Thin" (for example, a range equal to or larger than 40 μm and equal to or smaller than 90 μm). The controller 15 sets the conveying speed to 50% when the thickness is thicker than "Thin" and in a range corresponding to "Thick" (for example, a range equal to or larger than 90 μm and equal to or smaller than 160 μm).

The controller 15 sets the conveying speed to 33% when the thickness is thicker than "Thick" and in a range corresponding to "Heavy" (for example, a range equal to or larger than 160 μm and equal to or smaller than 230 μm). Similarly, the conveying speed may be set to 33% when the thickness is in a range corresponding to "Extra Heavy" (for example, a range equal to or larger than 230 μm and equal to or smaller than 350 μm). The controller 15 may stop the conveying of the sheet P by the sheet supply device 10 when the thickness is less than "Thin" and in a range corresponding to "Too Thin" (for example, a range smaller than 40 μm). In some examples, the controller 15 may stop conveying the sheet P when the thickness is in the range corresponding to "Too Heavy".

In some examples, the conveying speed of the sheet P may be selectively adjusted in accordance with the thickness of the sheet P and to suppress the generation of the jam of the sheet P in the sheet supply device 10. Since the occurrence of the jam is suppressed, maintenance may be reduced and routinely planned to decrease cost.

It is to be understood that not all aspects, advantages and features described herein may necessarily be achieved by, or included in, any one particular example. Indeed, having described and illustrated various examples herein, it should be apparent that other examples may be modified in arrangement and detail.

At least one operational condition of the first roller 11, the second roller 12, and the third roller 13 may be adjusted based on one or more medium properties of the sheet P. For example, the glossiness or the moisture content of the sheet P may be used as the medium property. The controller 15 may adjust the conveying speed of the sheet P based on the glossiness of the sheet P detected by the medium sensor 70. When it is determined that the sheet P is a glossy sheet based on the glossiness of the sheet P, the controller 15 may adjust the conveying speed so that the conveying speed becomes slow as compared with a case in which the sheet P is a normal sheet. Also by such control, the occurrence of the jam of the sheet P in the sheet supply device 10 can be suppressed.

A contact pressure with respect to the sheet P may be adjusted as at least one operational condition of the first roller 11, the second roller 12, and the third roller 13. For example, the controller 15 may adjust a contact pressure with respect to the sheet P of at least one of the first roller 11, the second roller 12, and the third roller 13 in accordance with the thickness and/or the glossiness of the sheet P. Also by such control, the occurrence of the jam of the sheet P in the sheet supply device 10 can be suppressed.

The controller 15 may adjust the conveying speed of the sheet P based on environment information such as temperature or humidity. Alternatively or additionally, the controller 15 may adjust the conveying speed of the sheet P based on the frequency of occurrence of jam of the sheet P and/or the number of printed sheets. In some examples, the controller 15 may perform self-learning based on the frequency of occurrence of jam of the sheet P and adjust the conveying speed of the sheet P in accordance with the result of the self-learning.

The first light receiving portion 72 may include both the diaphragm member 82 and the transparent diffusion member 83 as the optical member provided with the opening. In other examples, the first light receiving portion 72 may include one of the diaphragm member 82 and the transparent diffusion member 83. At least one of the first light receiving portion 72, the second light receiving portion 73, and the third light receiving portion 74 may not include the convex lens 81, the diaphragm member 82, and/or the transparent diffusion member 83. For example, the medium sensor 80 may include the light receiving portion 72A of the example imaging apparatus instead of the first light receiving portion 72.

The invention claimed is:

1. An imaging system comprising:

a roller to convey a printing medium;

a medium sensor to detect a medium property of the printing medium conveyed by the roller; and a controller to adjust a conveyance speed of the printing medium by the roller based on the medium property detected by the medium sensor, wherein the medium sensor comprises a light emitting portion and a light receiving portion, and wherein the light receiving portion comprises:

a convex lens to receive and focus incident light;

a diaphragm member provided with an opening located at a focal position of the convex lens to pass the focused incident light;

a transparent diffusion member to receive and diffuse the focused incident light received through the opening; and a detector to detect diffused light received from the transparent diffusion member.

2. The imaging system according to claim 1, wherein the medium property comprises a thickness of the printing medium.

3. The imaging system according to claim 1, wherein the medium property comprises glossiness of the printing medium.

4. The imaging system according to claim 1,
wherein the light emitting portion is to irradiate light on the printing medium conveyed by the roller and the light receiving portion is to detect the light incident on the printing medium.

5. The imaging system according to claim 4,
wherein the light receiving portion is to detect a first part of the light that is transmitted through the printing medium, and
wherein the imaging system further comprises a second light receiving portion to detect a second part of the light that is reflected by the printing medium and a third light receiving portion to detect a third part of the light that is diffused and reflected by the printing medium.

6. The imaging system according to claim 5, wherein the second light receiving portion and the third light receiving portion each comprise a same structure as the light receiving portion.

7. The imaging system according to claim 1, wherein the transparent diffusion member comprises a light shielding layer provided with an opening.

8. An imaging system comprising:
a roller to convey a printing medium;
a medium sensor to detect a glossiness of the printing medium conveyed by the roller; and
a controller to adjust an operational condition of the roller based on the glossiness detected by the medium sensor,
wherein the medium sensor comprises a light emitting portion and a light receiving portion, and
wherein the light receiving portion comprises:
a lens barrel including a convex lens at a front end;
a diaphragm member located inside the lens barrel and having an opening located at a focal position of incident light on the convex lens;
a transparent diffusion member located inside the lens barrel to receive and diffuse light passed through the opening; and
a detector to detect diffused light received from the transparent diffusion member.

9. The imaging system according to claim 8,
wherein the controller is to adjust a conveyance speed of the printing medium by the roller in accordance with the glossiness.

10. The imaging system according to claim 8,
wherein the controller is to adjust a contact pressure of the roller with respect to the printing medium in accordance with the glossiness.

11. An imaging system comprising:
a roller to convey a printing medium;
a medium sensor to detect a medium property, the medium sensor comprising a light emitting portion to irradiate light on the printing medium conveyed by the roller and a light receiving portion to detect the light incident on the printing medium; and
a controller to adjust an operational condition of the roller based on the medium property detected by the medium sensor,
wherein the light receiving portion comprises:
a convex lens;
an optical member including a diaphragm having an opening located at a center of the diaphragm, the optical member forming a telecentric optical system with the convex lens;
a detector to detect light; and
a diffusion layer located between the detector and the diaphragm.

12. The imaging system according to claim 11, wherein the medium property comprises a thickness of the printing medium.

13. The imaging system according to claim 11, wherein the medium property comprises a glossiness of the printing medium.

14. The imaging system according to claim 11,
wherein the controller is to adjust a conveyance speed of the printing medium by the roller in accordance with the medium property.

15. The imaging system according to claim 11, wherein the diffusion layer comprises:
a transparent diffusion member; and
a light shielding layer having an opening located at a center of the light shielding layer, the light shielding layer located between the transparent diffusion member and the diaphragm.

16. The imaging system according to claim 11, wherein the diaphragm and the diffusion layer each has a disc shape.

* * * * *